US006491278B1

(12) United States Patent
Thomsen

(10) Patent No.: US 6,491,278 B1
(45) Date of Patent: Dec. 10, 2002

(54) PLATFORM FOR NOTEBOOK COMPUTER

(75) Inventor: Walter Christian Thomsen, Plymouth, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/655,135

(22) Filed: Sep. 5, 2000

(51) Int. Cl.[7] ..... A47B 97/04
(52) U.S. Cl. ..... 248/460; 108/43; 108/180
(58) Field of Search ..... 248/460, 462, 248/174, 150; 108/43, 180

(56) References Cited

U.S. PATENT DOCUMENTS

| | | | | |
|---|---|---|---|---|
| 4,333,602 A | * | 6/1982 | Geschwender | 206/631 |
| 4,837,590 A | | 6/1989 | Sprague | 346/145 |
| 5,078,460 A | | 1/1992 | Holsinger | 312/244 |
| 5,209,452 A | | 5/1993 | Goldberg | 248/676 |
| 5,232,276 A | | 8/1993 | Martin | 312/208 |
| 5,315,935 A | * | 5/1994 | Weinsenfels | 248/460 X |
| 5,365,860 A | | 11/1994 | Billington, III | 108/108 |
| 5,480,119 A | * | 1/1996 | Fish et al. | 248/460 |
| 5,553,824 A | | 9/1996 | Dutra, Jr. | 248/346.07 |
| 5,630,566 A | | 5/1997 | Case | 248/122.1 |
| 5,639,004 A | | 6/1997 | Carlton et al. | 224/579 |
| 5,794,782 A | * | 8/1998 | Ascik | 206/600 |
| 5,899,421 A | | 5/1999 | Silverman | 248/175 |
| 6,076,787 A | | 6/2000 | Troyer | 248/166 |
| 6,098,820 A | * | 8/2000 | Smith | 248/174 |
| 6,126,254 A | * | 10/2000 | Maglione | 248/174 X |
| 6,213,439 B1 | * | 4/2001 | Giulie et al. | 248/459 |

FOREIGN PATENT DOCUMENTS

DE 4203403 A1 8/1993 ..... G06F/1/16

* cited by examiner

*Primary Examiner*—Ramon O. Ramirez
(74) *Attorney, Agent, or Firm*—Robert W. Lahtinen; James R. Nock

(57) ABSTRACT

A light weight, portable platform for supporting a notebook or laptop type computer elevates the computer monitor to a user friendly height above a supporting table or desk top surface. The platform back, sides and top may be interconnected using hook and loop tape and can be readily assembled and disassembled without the use of tools or separate connecting parts that may be misplaced or lost. The platform stores flat for transport with the principal elements occupying less volume than the compact computer it supports in the assembled mode. The platform comprises a pair of side members, a back member and a top member, with the alternative that the bottom surface of the supported computer may serve as the top member of the platform.

7 Claims, 4 Drawing Sheets

PLATFORM FOR NOTEBOOK COMPUTER

FIELD OF THE INVENTION

The present invention pertains to personal computers and more particularly to a light weight, portable platform for laptop or notebook computers.

BACKGROUND OF THE INVENTION

The extensive use of computers for extended time periods has revealed that monitor position is a concern with respect to operator well being. It appears that the monitor viewing surface should be at eye level for comfortable, healthful viewing during the longer periods of operation that have become common.

Laptop or notebook computers are used extensively by people that seek computer availability while traveling and at a variety of destinations. A notebook computer often becomes the computer of choice for many who find its use necessary much of the time and continue use even in a permanent office environment, both from habit and the fact that much of their user data is on that device.

The notebook computer is formed as a single unit for compactness, to enable it to be safely transported and prevent any parts from being lost, mislaid or otherwise separated from the device. The inappropriate positioning of the monitor can be tolerated as a trade off for the convenience of availability in many transient locations. However, when the notebook is used at a destination for an extended period of time or in a permanent office, the ergonomic unfriendliness of a poorly positioned monitor becomes more apparent and less acceptable. This deficiency may be overcome by a device to elevate and support the notebook at a proper level. Available apparatus for this purpose is adequate, but awkward. An elevated support must not only be structurally adequate and sufficiently rigid for use, but also must be light weight and compact for transport so that it does not materially increase the weight or bulk of the system when being transported.

SUMMARY OF THE INVENTION

The notebook computer platform of the present invention includes four panels that form the platform sides, back and top and may be packed flat for transport as a stack wherein the length and width do not exceed the footprint (length and width) of the notebook computer it will support. The four pieces form the entire structure without separate attachment devices. This may be effected by securing the parts to one another using hook and loop attachment tape adhered to the parts. The design, as described, uses hook and loop tape interfaces which, in the assembled condition, serve only to secure the platform parts to one another and do not carry the weight of the notebook computer. Alternately the sides could be permanently hinged to the back panel to allow the sides to be folded against the back in the stored condition while making the assembly a single part. The structure could be further simplified by securing self adhesive hook and loop tape to the bottom surface of the notebook computer with which the platform is used. The computer bottom wall then becomes the top of the platform.

The platform not only provides a sturdy support affording an elevated monitor location, but also stores compactly when disassembled and could be employed to provide additional protection for the notebook computer within the brief case or carrying case used for transport.

DETAILED DESCRIPTION

Figure 1:
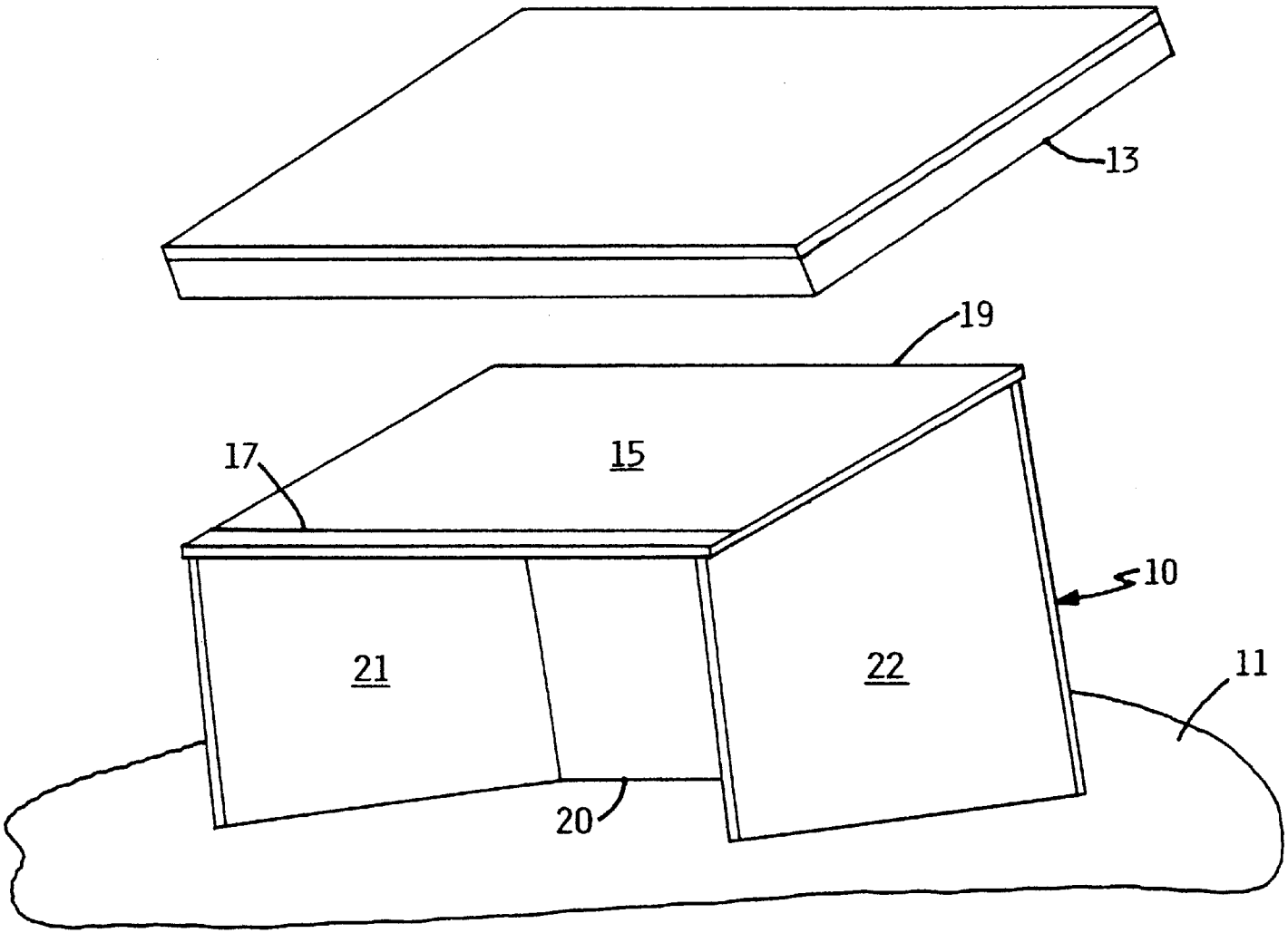
FIG. 1 shows the portable platform of the present invention on a support surface with a typical laptop or notebook computer above and separated from the platform support surface.

Referring to the drawings, FIG. 1 shows the light weight, portable notebook computer platform 10 of the present invention in assembled form, resting on the surface 11 with a notebook computer 13 shown above the support surface 15 on which it will rest during operation. When positioned on the platform 10, the computer is restrained with respect to movement relative to the platform support surface 15 by a strip of anti-skid material 17. The strip 17 may be of any suitable material that inhibits slippage between confronting surfaces, but is shown as a strip of hook and loop tape.

Figure 2:
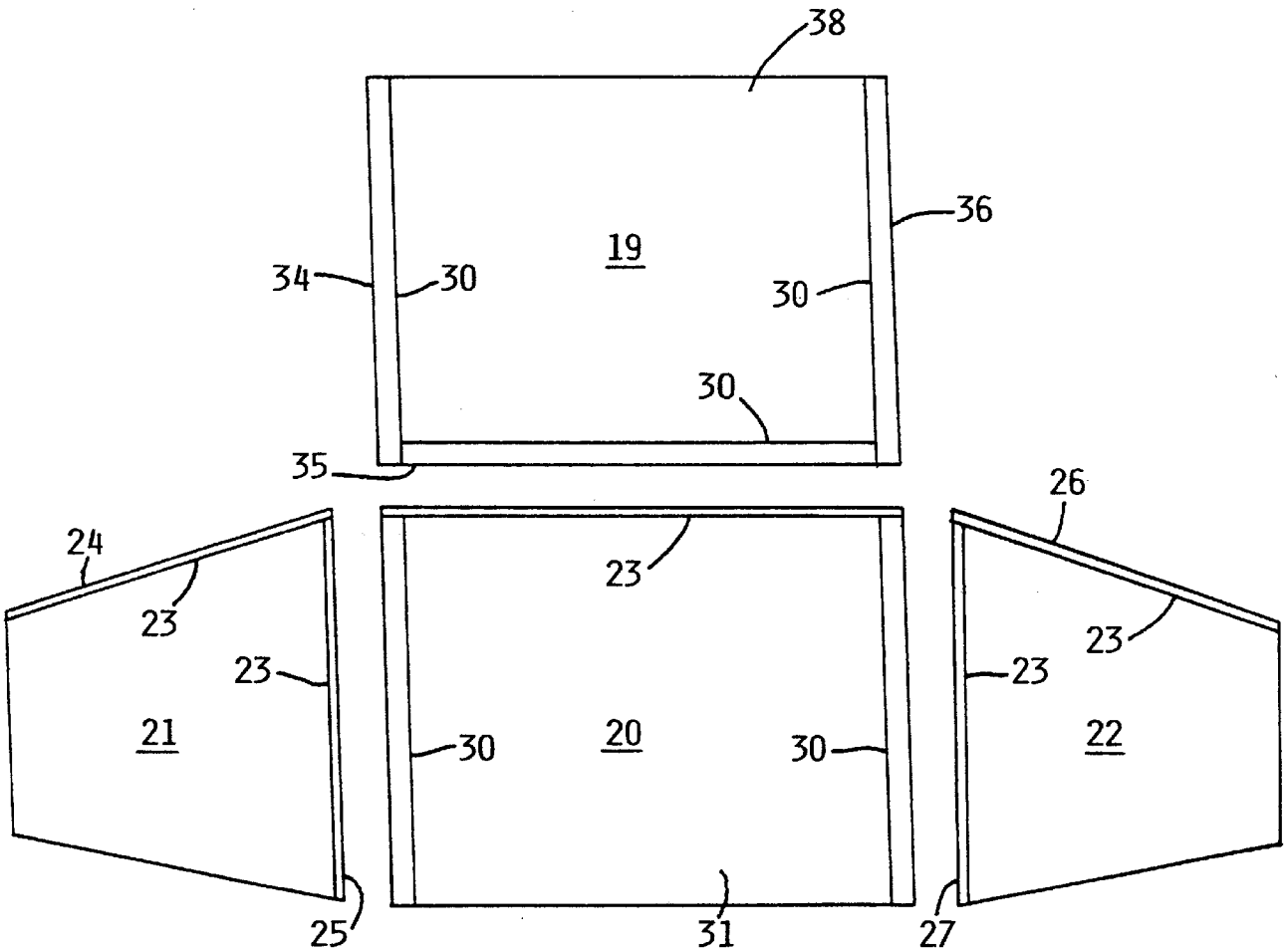
FIG. 2 shows a plan view of the four parts of the platform with the sides and top rotated 90 degrees into a common plane with the back.

As illustrated in FIG. 2, the platform 10 consists of four flat members that can be stacked and stored for transport: a top member 19, a back member 20, a left side member 21 and a right side member 22. The four parts of the platform may be formed of any suitable rigid, light weight material such as corrugated card board. However, as shown, quarter inch foam core panels, such as are used as backing for mounting posters, are used as the material of choice. The side members 21, 22 are trapezoidal in form to cause the back member 20 to have an inclination in the assembled condition. The members of the assembly are releaseably secured to one another in the assembled condition by self-adhesive hook and loop tape. One form of the hook and loop tape 23 is wrapped about the edges 24, 25 of left side member 21; edges 26, 27 of right side member 22; and the edge 28 of back member 20. The other form of hook and loop tape 30 is secured to the back member 20 on the surface 31 adjacent the edges 32, 33. The under side 38 of the top member 19 also has the other form of hook and loop tape 30 adhered along the edges 34, 35 and 36.

The platform is assembled by abutting the side member edges 25 and 27 respectively against tape strips 30 of the back member 20 and placing the top member 19 with the tape strips 30 on the lower surface 38 abutting the. side and back edges 24, 26, and 28. This attachment means provides angular restraint for the side members.

The platform is used to present the computer monitor at a good viewing height. Most available monitor risers not only fail to be sufficiently compact and light weight, but also do not adequately elevate the monitor to overcome the inherent problems. To be effective for individuals of average stature, about a 9 inch elevation of the monitor should be attained. The platform structure of this invention is formed of economical materials and would be easily adaptable to varying dimensions to attain heights to meet the needs of various users. The forwardly downward inclination of the keyboard portion of the computer makes the use of the keyboard and cursor control more operator friendly. At a destination or in the operator's office, many users may feel that a mouse and a separate keyboard at desk top height should be employed. To implement the use of a mouse and a separate keyboard, a user may include a cable splitter with the notebook computer equipment to allow simultaneous attachment. The platform assembly of the present invention, using the materials of the preferred embodiments results in a device that weighs only 6 ½ ounces (and less if the top member is eliminated as shown and described). The platform members in the disassembled, stacked form present a volume less than the portable computer it supports, making it readily transportable in the same case as the computer. The component parts of the platform could be placed in one or a few separate locations within the computer carrying case to provide additional mechanical protection for the computer during transport.

Figure 3:
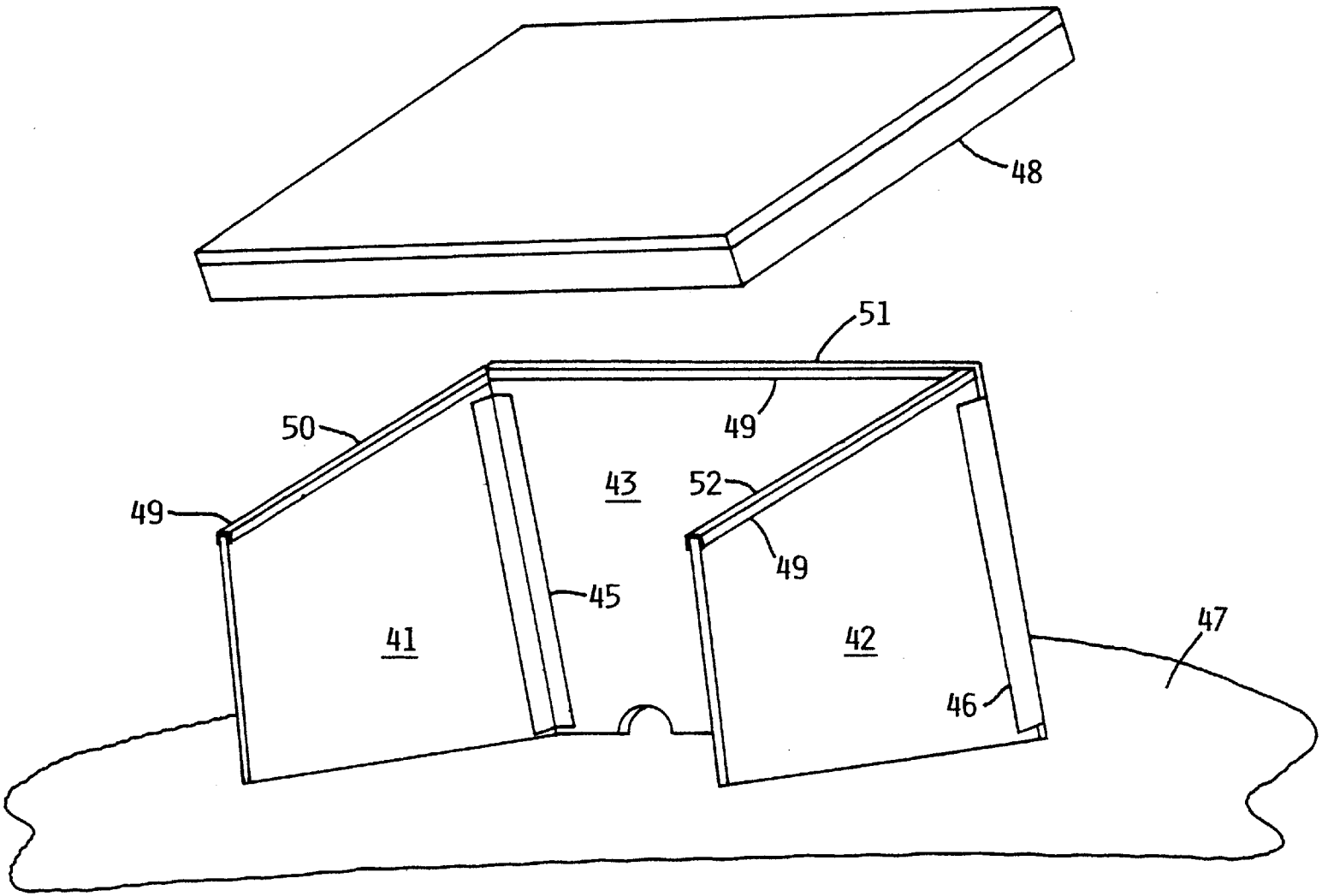
FIG. 3 illustrates an alternate embodiment of the platform of the invention wherein the sides and back are hinged together and the computer to be supported provides the top member.
Figure 4:
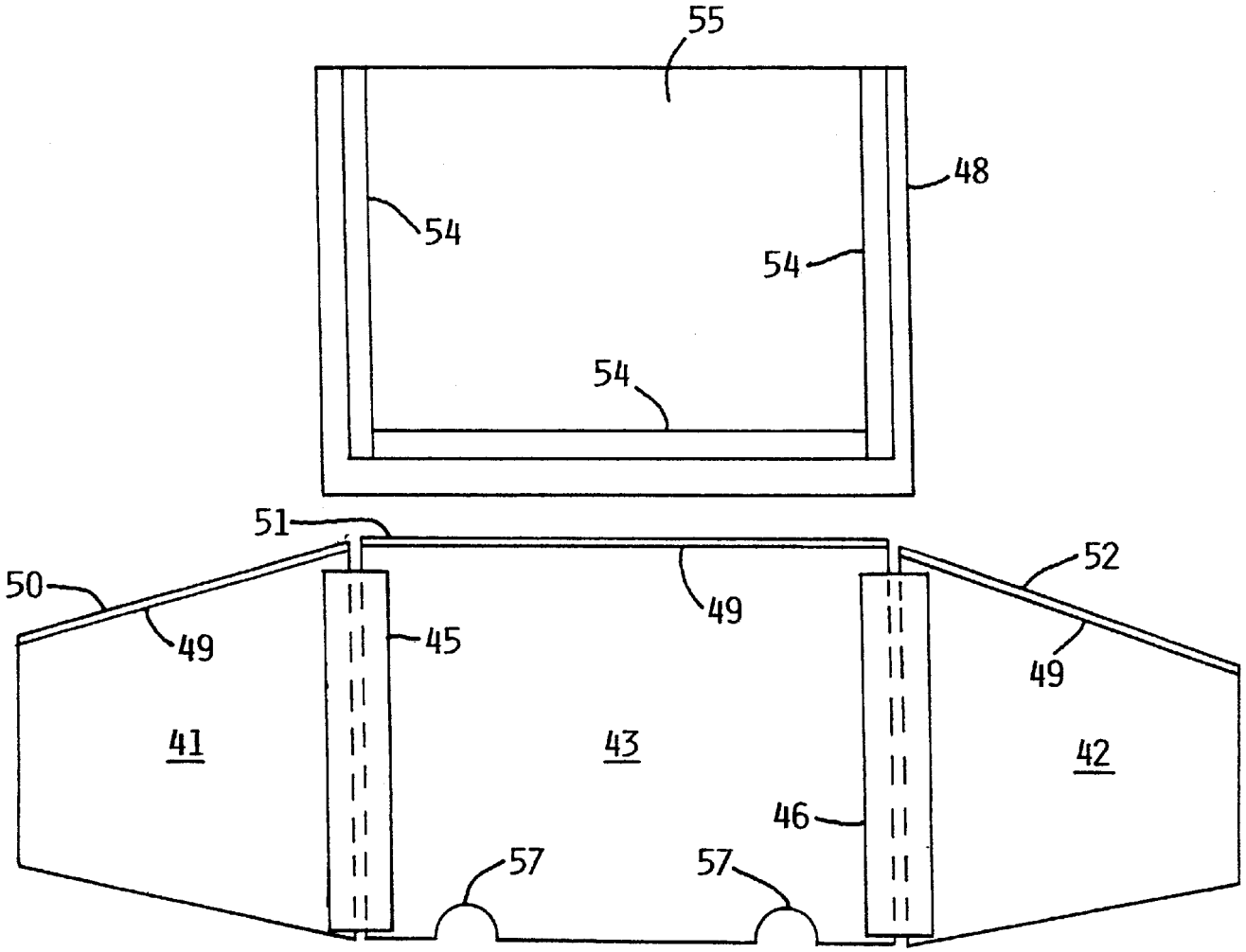
FIG. 4 is a view, similar to FIG. 2, showing the embodiment of FIG. 3 with the elements rotated into a common plane.

FIGS. 3 and 4 illustrate a second embodiment of the invention. In this embodiment the left side member 41 and right side member 42 are secured to the back member 43 by hinge elements 45 and 46 respectively. Though any suitable hinge may be used, the members may be hinged to one another by flexible plastic or fabric hinge materials that permit the side to pivot from the assembled position, shown in FIG. 3, to a stored condition wherein the side 41, 42 fold to a position parallel and abutting the back member 43, preferably at opposite surfaces of said back member. When side members 41, 42 are pivoted to the operating position shown in FIG. 3, the assembly of back and side members rests on a support surface 47 such as a table or desk top.

In this embodiment, the notebook computer 48 serves as the top member, further reducing the weight and stored volume of the platform assembly. One form of hook and loop tape 49 is wrapped over and along the upper edges 50, 51, and 52 of left side member 41, back member 43 and right side member 42 respectively. The cooperating other form of hook and loop tape is adhered to the bottom surface 55 of the notebook computer as illustrated by the tape strips 54.

The back member 43 is also provided with notches 57 extending from the lower edge. The space within the platform may be used for free standing auxiliary equipment such as an additional drive. The cabling and power cord can extend through the notches 57 making it unnecessary to destabilize the platform or have such connecting lines routed about the front of the work station.

It will be appreciated that variations and combinations of the first and second embodiments may be used. The laptop or notebook computer may serve as the top member of a side and back assembly as shown in FIGS. 1 and 2 and the side and back member structure of FIGS. 3 and 4 may be used with a top member such as top member 19 of FIGS. 1 and 2.

What is claimed is:

1. A portable platform for use as a work station on a supporting surface comprising a top member having an upper surface and a lower surface;

a pair of side members each having an upper edge, a lower edge, a front edge and a rear edge;

a back member with upper and side edges;

first attachment means for releaseably securing the rear edge of each said side member to said back member respectively adjacent the side edges thereof; and second attachment means for releaseably securing said top member lower surface to the upper edges of said side members and said back member, said second attachment means providing horizontal angular restraint for said side members, wherein said first and said second attachment means provide structural support for said portable platform.

2. The portable platform of claim 1 wherein said first attachment means and said second attachment means both comprise hook and loop tape.

3. The portable platform of claim 2 wherein said first attachment means comprises hook and loop tape with one of such tape types adhered to and wrapped about the rear edge of each of said side members and the other of the tape types is adhered to the surface of said back member adjacent the side edges, whereby placing the rear edges of said side members in abutting relation with the back member surface adjacent the edge at the location of tape attachment releaseably secures the side members to the back member and said second attachment means comprises hook and loop tape with one of such tape types adhered to and wrapped about the upper edges of said side and back members and the other of such tape types is adhered to the lower surface of said top member at the locations of engagement with the side and back member edges when said top member is placed over and in engagement with said side and back member upper edges, whereby said top member is releaseably attached to said side and back members.

4. The portable platform of claim 2 wherein the length of each said side member front edge is less than the length of the rear edge, whereby the top member and any device supported thereby is inclined toward the front edge.

5. The portable platform of claim 4 wherein said top, rear and side members are formed of rigid, light weight material from the group consisting of cardboard and foam core panels.

6. The portable platform of claim 4 further comprising a non-slip material applied to a portion of the upper surface of said top member to resist relative movement between said top member and a device supported thereon.

7. The portable platform of claim 2 wherein said pair of side members and said back member have bottom edge surfaces which engage the supporting surface upon which the platform rests and further comprises a notch formed in at least one of said bottom edge surfaces through which cable connections may extend.

* * * * *